US008440069B2

(12) United States Patent
Wright et al.

(10) Patent No.: US 8,440,069 B2
(45) **Date of Patent: *May 14, 2013**

(54) METHODS OF ISOLATING AND USING COMPONENTS FROM A HIGH SOLVENCY DISPERSIVE POWER (HSDP) CRUDE OIL

(75) Inventors: Chris A. Wright, Bordentown, NJ (US); Glen B. Brons, Phillipsburg, NJ (US); Sharon Feiller, Allentown, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 367 days.

This patent is subject to a terminal disclaimer.

(21) Appl. No.: 12/292,648

(22) Filed: Nov. 24, 2008

(65) Prior Publication Data

US 2009/0127166 A1 May 21, 2009

Related U.S. Application Data

(63) Continuation-in-part of application No. 12/219,180, filed on Jul. 17, 2008.

(60) Provisional application No. 60/935,321, filed on Aug. 6, 2007.

(51) Int. Cl.
*C10C 3/00* (2006.01)

(52) U.S. Cl.
USPC ..... 208/48 AA; 208/47; 208/48 R

(58) Field of Classification Search ..... 208/47, 208/48 R, 48 AA
See application file for complete search history.

(56) References Cited

U.S. PATENT DOCUMENTS

| | | | |
|---|---|---|---|
| 2,276,155 | A | 3/1942 | Carr |
| 3,321,395 | A | 5/1967 | Paterson |
| 3,830,732 | A | 8/1974 | Gatsis |
| 4,515,685 | A | 5/1985 | Yeh |

(Continued)

FOREIGN PATENT DOCUMENTS

| | | | |
|---|---|---|---|
| EP | 0125709 | B1 | 2/1989 |
| WO | 2008024309 | A2 | 2/2008 |
| WO | 2008024323 | A2 | 2/2008 |
| WO | 2009085062 | A1 | 7/2009 |

OTHER PUBLICATIONS

Gary, J.H. et al. (2007). Petroleum Refining Technology and Economics, CRC Press, 465 pgs (Office action cites p. 3).*

(Continued)

*Primary Examiner* — Brian McCaig
(74) *Attorney, Agent, or Firm* — Glenn T. Barrett

(57) ABSTRACT

Method of isolating active resins from a high solvency dispersive power (HSDP) crude oil includes providing a HSDP crude oil, deasphalting the HSDP crude oil into at least a deasphalted oil (DAO) fraction and a first asphaltenes fraction, deasphalting the first asphaltenes fraction to isolate active resins from a second asphaltenes fraction, and combining the DAO fraction and the second asphaltenes fraction to form a de-resinated crude. Method of using components isolated from a high solvency dispersive power (HSDP) crude oil includes providing a HSDP crude oil, deasphalting the HSDP crude oil into at least a deasphalted oil (DAO) fraction and a first asphaltenes fraction, deasphalting the first asphaltenes fraction to isolate active resins from a second asphaltenes fraction, and selecting at least one of the DAO fraction, the active resins, or the second asphaltenes fraction for use in a refinery process.

29 Claims, 5 Drawing Sheets

$\Delta T = T_{OUTLET} - T_{OUTLET\ MAX}$
; MEASURES HEAT TRANSFER OF FOULANT LAYER

U.S. PATENT DOCUMENTS

| | | | | |
|---|---|---|---|---|
| 4,655,903 | A | 4/1987 | Rahbe et al. | |
| 4,671,103 | A | 6/1987 | Dickakian | |
| 4,686,028 | A | 8/1987 | Van Driesen et al. | |
| 4,853,337 | A | 8/1989 | Dickakian | |
| 5,124,025 | A | 6/1992 | Kolstyad et al. | |
| 5,863,415 | A | 1/1999 | Zetlmeisl | |
| 5,871,634 | A | 2/1999 | Wiehe | |
| 5,997,723 | A | 12/1999 | Wiehe | |
| 6,048,904 | A | 4/2000 | Wiehe et al. | |
| 6,355,159 | B1 | 3/2002 | Myers | |
| 6,706,669 | B2 | 3/2004 | Sartori et al. | |
| 2004/0072361 | A1 | 4/2004 | Varadaraj et al. | |
| 2004/0121472 | A1 | 6/2004 | Nemana | |
| 2006/0021907 | A1 | 2/2006 | Varadaraj et al. | |
| 2006/0042661 | A1 | 3/2006 | Myers | |
| 2006/0219266 | A1 | 10/2006 | Meyer | |
| 2007/0023323 | A1 | 2/2007 | Van Den Berg et al. | |
| 2008/0041762 | A1 * | 2/2008 | Brons et al. | 208/18 |

OTHER PUBLICATIONS

Speight, J.G. (1999). The Chemistry and Technology of Petroleum, 3rd ed., Marcel Dekker, 918 pgs (Office action cites p. 32).*

Al-Sahhaf, T.A. et al. (2002). Fluid Phase Equilibria, 194-197, pp. 1045-1057.*

Rahimi, P.M. et al. (2004). Prepr. Pap.-Am. Chem. Soc. Div. Pet. Chem., 49(2), pp. 147-149.*

PCT/US2009/006254, PCT International Search Report, Form PCT/ISA/210, dated Dec. 28, 2010 6 pgs.

PCT/US2009/006254, PCT Written Opinion of the International Searching Authority, Form PCT/ISA/237, dated Dec. 28, 2010 9 pgs.

Carnahan, Norman F, et al. "Properties of Resins Extracted from Boscan Crude Oil and Their Effect on the Stability of Asphaltenes in Boscan and Hamaca Crude Oils", Energy & Fuels, Jan. 1999, vol. 13, No. 2, pp. 309-314.

Goual, Lamia, et al. "Effect of Resins and DBSA on Asphaltene Precipitation from Petroleum Fluids", AlChE Journal, Feb. 2004, vol. 50, No. 2, pp. 470-479.

Leon, O, et al. "Asphaltenes: Structural Characterization, Self-Association, and Stability Behavior", Energy & Fuels, Jan. 2000, vol. 14, No. 1, pp. 6-10.

Carbognani, L., et al. "Complex Nature of Separated Solid Phases from Crude Oils", Energy & Fuels, Feb. 1999, vol. 13, No. 2, pp. 351-358.

The Oil Compatibilit Model and Crude Oil Incompatibility, Wiehe and Kennedy, Energy & Fuels 2000, vol. 14, pp. 56-59, published Dec. 14, 1999.

PCT International Search Report, PCT/US2009/053371,Form PCT/ISA/210, mailed Nov. 27, 2009, 4 pgs.

PCT Written Opinion of the ISA, PCT/US2009/053371, Form PCT/ISA/237, mailed Nov. 27, 2009, 7 pgs.

Wiehe, Irwin A., "Fouling of Nearly Incompatible Oils", American Chemical Society, Journal, Energy & Fuels (2001), 15 (5), 1057-1058.

Wiehe, Irwin A., "Prevention of Fouling by Incompatible Crudes With the [Crude] Oil Compatibility Model", ALChE 1999 Spring National Meeting (Houston Mar. 14-18, 1999) Preprint N. 9.

International Search Report, PCT/US2007/018403, mailed Sep. 25, 2008.

Written Report, PCT/US2007/018403, mailed Sep. 25, 2008.

International Search Report, PCT/US2009/053374, mailed Nov. 20, 2009

Written Opinion, PCT/US2009/053374, mailed Nov. 20, 2009.

Ali et al.: "Structural Representation of Asphaltene GPC Fractions Derived from Kuwaiti Residual Oils", Energy & Fuels, vol. 20, No. 1, Nov. 24, 2005.

International Search Report, PCT/US2008/009411, mailed Feb. 18, 2009.

Written Opinion, PCT/US2008/009411, mailed Feb. 18, 2009.

Deasphalted Oil: A Natural Asphaltene Solvent, Jamaluddin et al., SPE Production & Facilities, Aug. 1996, p. 161-165.

The Effectiveness of Deasphalted Oil in the Stability of Visbroken Athabasca Bitumen, Rahimi et al., Prepr. Pap.-AM. Chem. Soc., Div. Pet. Chem., 2004, p. 147-149.

Retardation of Asphaltene Precipitation by Addition of Toluene, Resins, Deasphalted Oil and Surfactants, Al-Sahhaf et al., Fluid Phase Equilibria 194-197, 2002, p. 1045-1057.

* cited by examiner $\Delta T = T_{OUTLET} - T_{OUTLET\ MAX}$
; MEASURES HEAT TRANSFER OF FOULANT LAYER

METHODS OF ISOLATING AND USING COMPONENTS FROM A HIGH SOLVENCY DISPERSIVE POWER (HSDP) CRUDE OIL

CROSS REFERENCE TO RELATED APPLICATIONS

This application is a continuation-in-part of U.S. patent application Ser. No. 12/219,180, filed on Jul. 17, 2008, entitled "Method For Reducing Oil Fouling In Heat Transfer Equipment," which relates to and claims priority from U.S. Provisional Patent Application No. 60/935,321, filed on Aug. 6, 2007, entitled "Method for Reducing Oil Fouling in Heat Transfer Equipment," and which is also related, but does not claim priority to U.S. patent application Ser. No. 11/506,901, filed on Aug. 21, 2006 entitled "Method of Blending High Tan and High $S_{BN}$ Crude Oils and Method of Reducing Particulate Induced Whole Crude Oil Fouling and Asphaltene Induced Whole Crude Oil Fouling."

FIELD OF THE INVENTION

The present invention relates to the processing of whole crude oils, blends and fractions in petroleum refineries and other plants processing such materials, for example, petrochemical plants. In particular, the present invention relates to a method of isolating active resins from a high solvency dispersive power (HSDP) crude oil and a method of using components isolated from a HSDP crude oil.

BACKGROUND OF THE INVENTION

Fouling is generally defined as the accumulation of unwanted materials on the surfaces of processing equipment and in petroleum processing, is the accumulation of unwanted deposits from a fluid of hydrocarbon origin on heat transfer surfaces in process units. By "heat transfer surfaces" is meant a surface across which heat is transferred from or to—usually, to—the hydrocarbon fluid, for example, the tube surfaces in furnaces and heat exchangers. Fouling has been recognized as a nearly universal problem in the design and operation of such equipment and affects the operation of equipment in two ways. First, the fouling layer has a low thermal conductivity. This increases the resistance to heat transfer and reduces the effectiveness of the unit. Second, as deposition occurs, the cross-sectional area is reduced, which causes an increase in pressure drop across the apparatus and creates inefficient pressure and flow in the unit.

Fouling in heat transfer equipment used for streams of petroleum origin can result from a number of mechanisms including chemical reactions, corrosion and the deposit of materials made insoluble by the temperature difference between the fluid and heat exchange wall. When crude oils are passed through heat transfer equipment, for example, when the heating medium on the far side of the exchanger is much hotter than the oil, relatively high surface or skin temperatures can result and asphaltenes in the crude can precipitate from the oil and adhere to these hot surfaces. The presence of insoluble contaminants may exacerbate the problem: blends of a low-sulfur, low asphaltene (LSLA) crude oil and a high-sulfur, high asphaltene (HSHA) crude, for example, may be subject to a significant increase in fouling in the presence of iron oxide (rust) particulates. Subsequent exposure of the precipitated asphaltenes over time to the high temperatures then causes formation of coke as a result of thermal degradation.

Another common cause of fouling can result from the presence of salts and particulate which precipitate from the crude and adhere to the heated surfaces. Inorganic contaminants can play both an initiating and promoting role in the fouling of whole crude oils and blends: iron oxide, calcium carbonate, silica, sodium and calcium chlorides have all been found to be attached directly to the surface of fouled heater tubes and throughout coke deposits on the heater surfaces. Desalter units are still the only opportunity refineries have to remove such contaminants and inefficiencies often result from the carryover of such materials with the crude oil feeds.

Equipment fouling is costly to petroleum refineries and other plants in terms of lost efficiencies, lost throughput, and additional energy consumption, and, with the increased cost of energy, heat exchanger fouling has a greater impact on process profitability. Higher operating costs also accrue from the cleaning required to remove fouling. While many types of refinery equipment are affected by fouling, cost estimates have shown that the majority of profit losses occur due to the fouling of whole crude oils, blends and fractions in pre-heat train exchangers.

The cleaning process, whether chemical or mechanical, in petroleum refineries and petrochemical plants often causes costly shutdowns; most refineries practice off-line cleaning of heat exchanger tube bundles based on scheduled time or usage or on actual monitored fouling conditions. Reduction in the extent of fouling will lead to increased run lengths, improved performance and energy efficiency while also reducing the need for costly fouling mitigation options.

It would be desirable to prevent the precipitation/adherence of particulates and asphaltenes on heated transfer surfaces before the particulates can promote fouling and the asphaltenes become thermally degraded or coked. By keeping asphaltenes in solution and particulates in suspension, the initial precipitation and subsequent thermal degradation of organic deposits and accumulation of particulates can be substantially reduced.

One contributing cause of fouling is the processing of blends of petroleum oils of different origin in the refinery. Blending of oils in refineries is common, but certain blends are incompatible and cause precipitation of asphaltenes that can rapidly foul process equipment. Although most blends of unprocessed crude oils are not potentially incompatible, once an incompatible blend is obtained, the rapid fouling and coking that results usually requires shutting down the refining process in a short time. One mitigating approach has been to ensure that two or more potentially incompatible petroleum oils are blended in a manner which maintains compatibility. U.S. Pat. No. 5,871,634 (Wiehe) discloses a method of blending that includes determining the insolubility number ($I_n$) for each feedstream and determining the solubility blending number ($S_{BN}$) for each stream and combining the feedstreams such that the $S_{BN}$ of the mixture is greater than the $I_n$ of any component of the mix. In another method, U.S. Pat. No. 5,997,723 (Wiehe) uses a blending method in which petroleum oils are combined in certain proportions in order to keep the $S_{BN}$ of the mixture higher than 1.4 times the $I_n$ of any oil in the mixture. Reference is made to U.S. Pat. Nos. 5,871,634 and 5,997,723 for a description of the methods by which $S_{BN}$ and $I_n$ may be determined. Some blending guidelines suggest a $S_{BN}/I_n$ blend ratio>1.3 and a $\Delta(S_{BN}-I_n)>10$ to minimize asphaltene precipitation and fouling. However, these blends are designed for use as a passive approach to minimizing asphaltene precipitation.

In related application Ser. No. 11/506,901, a method is described for reducing asphaltene induced fouling and particulate induced fouling by blending crude oils with certain high solvency dispersive power (HSDP) crude oils. While this method is effective as described, it may not be convenient for each and every refinery to make use of the method since access to cargoes of the proper HSDP crudes may not be easy.

SUMMARY OF THE INVENTION

The present application provides a method of isolating active resins from a high solvency dispersive power (HSDP) crude oil. The method includes providing a HSDP crude oil; deasphalting the HSDP crude oil into at least a deasphalted oil (DAO) fraction and a first asphaltenes fraction; deasphalting the first asphaltenes fraction to isolate active resins from a second asphaltenes fraction; and combining the DAO fraction and the second asphaltenes fraction to form a de-resinated crude.

Deasphalting the HSDP crude oil can include providing a first solvent, which can be pentane. Deasphalting the first asphaltenes fraction can include providing a second solvent, which can be heptane. The HSDP crude oil can have a TAN level greater than about 0.3 mg KOH/g. The HSDP crude oil can have a $S_{BN}$ level greater than about 90. The HSDP crude oil can contain n-heptane asphaltenes. The HSDP crude oil can be provided as a fraction of whole crude oil, such as an atmospheric resid, vacuum resid, propane asphaltenes, or butane asphaltenes fraction.

In accordance with another aspect of the invention, a method of using components isolated from a high solvency dispersive power (HSDP) crude oil is provided. The method includes providing a HSDP crude oil; deasphalting the HSDP crude oil into at least a deasphalted oil (DAO) fraction and a first asphaltenes fraction; deasphalting the first asphaltenes fraction to isolate active resins from a second asphaltenes fraction; and selecting at least one of the DAO fraction, the active resins, or the second asphaltenes fraction for use in a refinery process.

As embodied herein, the active resins can be blended with a base crude oil to create a blended crude oil to reduce fouling of a refinery component. The blended crude oil is fed to a refinery component. Furthermore, the DAO fraction and the second asphaltenes fraction can be combined to form a de-resinated crude. The de-resinated crude can be processed as a standard feed in a refinery crude slate. Alternatively, the de-resinated crude can be blended with a portion of the HSDP crude oil to reduce incompatibility between the DAO fraction and the second asphaltenes fraction before being processed as a standard feed in a refinery crude slate. In a further alternative, the deasphalted oil (DAO) fraction can be processed in a refinery or chemical plant component or used as a stream for blending with other refinery process streams, such as in the production of fuel oil. The second asphaltenes fraction can be used in asphalt production or processed in a thermal conversion unit, such as a coker.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method of the invention. Together with the written description, the drawings serve to explain the principles of the invention.

BRIEF DESCRIPTION OF THE DRAWINGS

The inventions will now be described in conjunction with the accompanying drawings in which.

DETAILED DESCRIPTION OF EMBODIMENTS OF THE INVENTION

Figure 1:
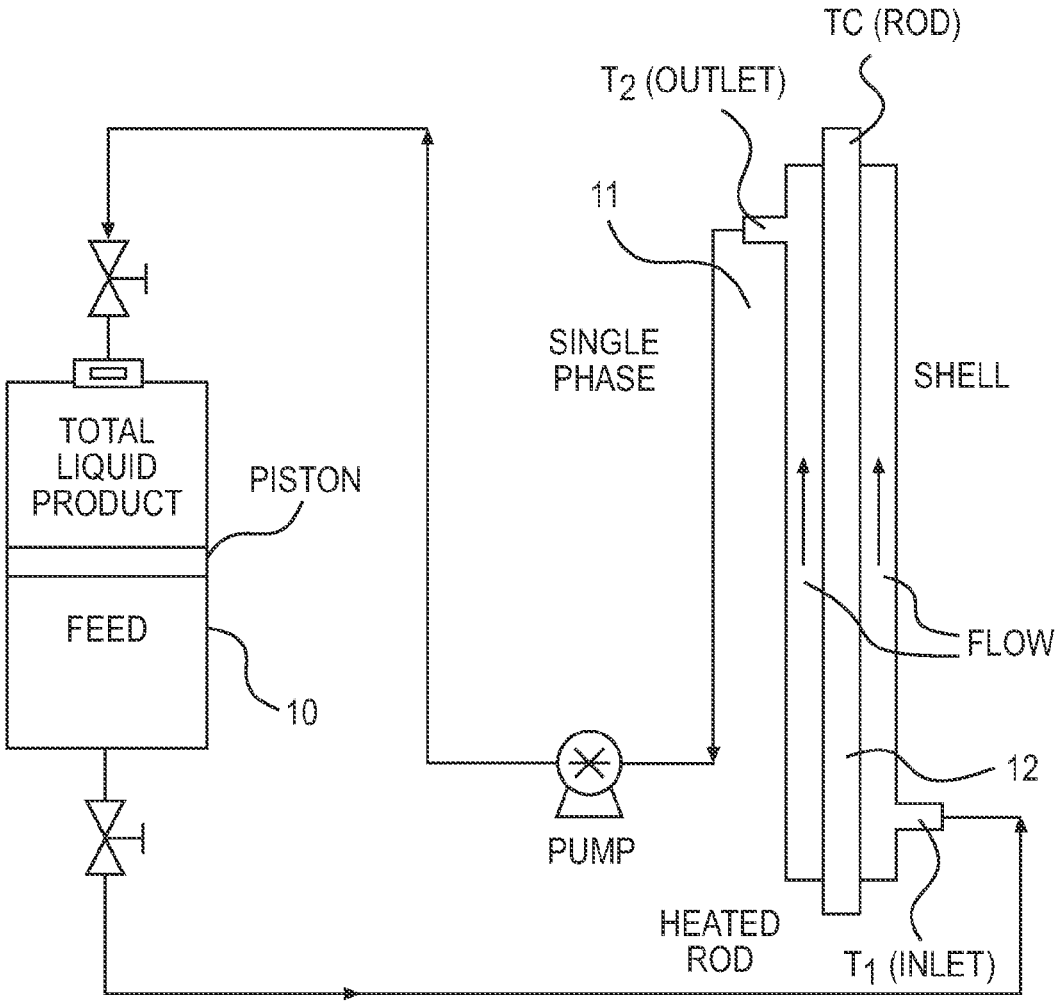
FIG. 1 shows a test rig used in experimental work to confirm the effect of the resin extracts on the thermal processing of petroleum oils in heat transfer equipment.

Reference will now be made in detail to present preferred embodiments of the inventions, examples of which are illustrated in the accompanying drawings. The method and corresponding steps of the invention will be described.

The addition of crude oil resinous extracts from high solvency and dispersancy power (HSDP) crudes having a high TAN and/or high $S_{BN}$ has been found to reduce asphaltene-induced fouling as well as particulate-induced fouling resulting from the heat treatment of oils of petroleum origin, including crude oils, blends of crude oils and fractions derived from such oils. The reduction in fouling is especially notable when working with the high boiling fractions (boiling over 350° C. (662° F.)) in which asphaltenes of varying molecular weights are encountered; the proportion of asphaltenes in the oils generally increasing with increasing boiling range of the fraction and in fractions boiling above 450° C. (842° F.), such asphaltenes may be present to a significant amount. The reduction in fouling is also particularly notable in asphaltic oils including those derived from Californian and Mexican crudes. The solvency effect of the resins plays a role in maintaining the asphaltenes in solution in the oils being processed in the heat transfer equipment and in so doing, helps to prevent fouling in plant equipment. In addition, certain components in the resin extracts act as dispersants for insoluble contaminants of inorganic origin, for example, salts and corrosion products and so tend to mitigate their negative effect on fouling.

Crude oil resins are a class of components of crude oils. In terms of molecular weight they are intermediate the oils in which they are soluble and the higher molecular weight asphaltenes. They may be recovered from the asphalt fraction of the oil and are therefore aptly described as asphaltic resins. Compositionally, the asphaltic resins used for the purpose of inhibiting asphaltene precipitation from crudes and crude fractions are maltenes. More importantly, they can be characterized by their solubilities in various organic solvents. The resins may be obtained by extraction of the asphalt fraction of a reduced petroleum crude oil with a light paraffinic solvent. The character of the resin produced will depend in part upon the solvent selected and resins of various properties may be obtained in this way; their utility as dispersants for any particular crude or blend of crudes or fraction may be determined empirically, for example, using a test method such as the one described below using an Alcor™ test rig.

The asphalt fraction of a crude oil is the fraction of the crude oil or a resid (atmospheric or vacuum) which is soluble in aromatic hydrocarbons, carbon disulfide and chlorinated hydrocarbons but insoluble in aliphatic hydrocarbons, especially the light paraffins which are used commercially in the refinery for removing the asphalt fraction from high boiling fractions, for example, in the production of lubricating oils. The most common paraffins used to precipitate asphalts from residual fractions are propane and n-pentane although butane, hexane and heptane and light naphthas, preferably 86-88° Beaumé, are also effective for this purpose. A common solvent used for characterization purposes is precipitation naphtha whose composition is defined in test method ASTM D91. The asphaltic fraction itself comprises a number of different materials with different solubility characteristics, including the light alkane insoluble fraction, referred to the asphaltene fraction and the light alkane soluble fraction commonly known as maltenes or petrolenes which can itself be resolved into further fractions including a resin which can be separated by percolation over alumina or by precipitation with propane. For the purposes of the present invention, however, it suffices to use a paraffin-soluble extract of the asphalt fraction, with the composition of the extract to be selected empirically by appropriate selection of the solvents used for the asphalt precipitation and resin extraction; the selection of the solvents is made in dependence upon the crude oil (or fraction) which requires treatment. Normally, the n-heptane soluble fraction of the asphalt fraction resulting from n-pentane precipitation will be found suitable for many crudes and fractions which are to be treated. However, the use of other asphalt precipitation liquids including propane, n-hexane and precipitation naphtha is not excluded. Alternative resin separation methods may also be used, including percolation over an adsorbent, the objective in each case being to obtain an extract of asphaltic resin of the appropriate properties for fouling mitigation with the crude or crude fraction to be treated. Assuming, therefore, that a dual solvent precipitation/extraction procedure is to be used, examples of which are described herein below, the compositions of the asphalt precipitant and resin solvent will be selected in combination one with another, the resin solvent typically being of higher molecular weight and boiling range than the asphalt precipitant. Thus, typical combinations of asphalt precipitant and resin solvent are: n-pentane/n-heptane; propane/n-pentane; propane/n-heptane; n-butane/n-hexane; n-butane/n-heptane. Heptane is normally excluded for the purpose of precipitating the asphalt because the resin fraction primarily useful for the present purpose is the heptane-soluble asphalt fraction but depending upon the resins to be used, heptane may be used to precipitate the asphalt although it will then be necessary to separate the resins from the heptane-soluble cut by other means, for example, by adsorption on activated alumina, silica gel or Fuller's Earth, followed by extraction with a solvent such as toluene or toluene/ethanol. Suitable resin recovery methods are mentioned in the Encyclopedia of Chemical Technology, Kirk-Othmer, Third Edition, John Wiley & Sons, NY 1978, ISBN 0-471-02039-7, Volume 3, page 286, to which reference is made for citation to such methods.

It is not necessary to make a total separation of the resin from the liquid fraction and, in fact, the resin can conveniently be used in the form of a solution in the solvent or in suitable carrier oil such as a light distillate fraction. If, however, desired, for example, to facilitate transport, the light paraffinic solvent may be removed by evaporation to leave what is essentially the resin itself in the form of a sticky mass which then requires no further purification although it may be desirable for blending purposes to take it up as a solution or suspension into a carrier fluid such as a light distillate, e.g. diesel oil, kerosene or even gas oil. In preferred forms of the treatment, the resin extract is added in solution or suspension in a solvent or carrier oil which has an end boiling point below 345° C. (650° F.) and typically below 200° C. (392° F.), i.e. is a naphtha or middle distillate fraction.

The resins, which may be recovered by the processes described above, are derived from a class of crude oils and crude oil fractions derived from such crudes, known as High Solvency Dispersive Power (HSDP) oils. These resins are believed to have properties which are characteristic of dispersant type molecules with a polar head and a non-polar tail. The crude oil fractions from which the resins may be derived include topped crudes, reduced crudes and resids (atmospheric or vacuum) since these will have the requisite boiling ranges to contain the resins. The asphalt fraction obtained in the deasphalting of vacuum resids is a fruitful source of the resins since they will be precipitated from the vac resid by the light alkane precipitant (propane or pentane) and the asphalt may then be extracted with the selected solvent, e.g. heptane, to recover the resins as the heptane soluble product. The HSDP oils, which are described in application Ser. No. 11/506,901, are oils which are characterized by a Solubility Blending Number ($S_{BN}$) of at least 75 and preferably at least 85 or 100 or higher, for example, 110. In addition, the HSDP oils from which the resins may be derived are also characterized preferentially by a Total Acid Number (TAN, the number expressed in milligrams (mg) of potassium hydroxide needed to neutralize the acid in one gram of oil) of at least 0.3, preferably at lest 1.0 or higher, e.g. 4.0. As in the case of the crude oil fouling mitigation method of Ser. No. 11/506,901, the degree of fouling reduction which may be achieved appears to be a function of the TAN level in the overall blend. This is believed to be due to the ability of the naphthenic acids present in the extracts to keep particulates present in the blends from wetting and adhering to the heated surface, where otherwise promoted and accelerated fouling/coking occur. The high $S_{BN}$ levels associated with most high TAN crudes have also been shown to aid in dissolving asphaltenes and/or keeping them in solution more effectively which also reduces fouling that would otherwise occur due to the incompatibility and near-incompatibility of crude oils and blends. Reference is made to application Ser. No. 11/506,901 for a further description of the HSDP oils.

The Solubility Blending Number is determined according to the method described in U.S. Pat. No. 5,871,634 and the Total Acid Number by the standard method of KOH titration, as prescribed by ASTM D-974 Standard Test Method for Acid and Base Number by Color-Indicator Titration.

One advantage of the use of the extracts is that the volume of required treatment fluid for reducing fouling is much lower, when compared to the use of the crude oil itself so that the relatively smaller amount of treatment fluid can be transported more easily to a plant needing it. In addition, the treatment extract is more potent and can be admixed in smaller amounts with the base crude oil and less expensive blending equipment along the lines of additive blenders can be used, as opposed to the larger volume mixing tanks needed when crude oils themselves need to be blended. For example, ppm levels may be effective to reduce fouling to the desired extent although the exact amount required will depend not only on the oil being treated but also on the type of resin used and on the thermal processing which the treated oil is expected to undergo: high thermal severities (high temperatures, long heating durations) will obviously stress the oil more and for this reason may require a heavier resin dosage than if a low severity process is used. Typically, the amount of resin (calculated on a solvent/carrier-free basis) will be at least 10 ppmw and in most cases 50 or 100 ppmw or more, typically up to 1000 ppmw with from 100 to 1000 ppmw being effective in most cases. Amounts of the order of 250-

1000 ppmw have been shown to be effective with crudes with a pronounced tendency to fouling. The maximum amount will normally be chosen as a matter of plant economics, and although amounts in excess of the amount needed to produce the desired reduction in fouling are not detrimental, they should be avoided as a matter of sound refinery practice. The maximum amount is not likely to exceed about 1 wt. pct. in most cases and usually, less than 0.5 wt. pct. will be adequate but as noted above, amounts up to 1000 ppmw will be effective. The exact amount selected will be determined empirically by simple experiment, for example, in a test rig such as the Alcor™ rig referred to below.

The base oil to be treated with the resin extract can consist of a whole crude oil, a blend of two or more crude oils fractions derived from a crude or crude blend, including topped crude, reduced crude, resids (atmospheric or vacuum), and hydrocarbon fractions derived by further processing, for example, gas oils, cycle oils, extracts and raffinates although the principle utility of the present fouling reduction technique will be with crudes and reduced crudes in the initial stages of processing where fouling problems have been prevalent.

The resin or resin extract can be mixed with the oil to be treated by conventional methods, for example, by liquid-liquid blending if the resin is in the form of a solution or dispersion in a solvent or carrier or by solid-liquid blending if the resin is used in solid (powder) form. The treated oil is then processed within the plant. The treated oil will be found to exhibit improved processing characteristics over the untreated oil and specifically will exhibit a significant reduction in fouling over untreated oils which contain particulates.

The resin fraction is a solid that can be melted at temperatures from about 100 to 150° C. (212 to 302° F.), so any solid resins added to the base oil will melt and homogenize into the base oil at exchanger temperatures.

In addition to the active resins, the process for isolating resins described above also results in by-product fractions including at least a deasphalted oil (DAO) fraction and a asphaltenes fraction. According to an alternative aspect of the invention, potential uses for the non-resin by-product fractions are described. As set forth herein, a method is provided for isolating active resins from a HSDP crude oil. The method includes providing a HSDP crude oil; deasphalting the HSDP crude oil into at least a deasphalted oil (DAO) fraction and a first asphaltenes fraction; deasphalting the first asphaltenes fraction to isolate active resins from a second asphaltenes fraction; and combining the DAO fraction and the second asphaltenes fraction to form a de-resinated crude.

Figure 3:
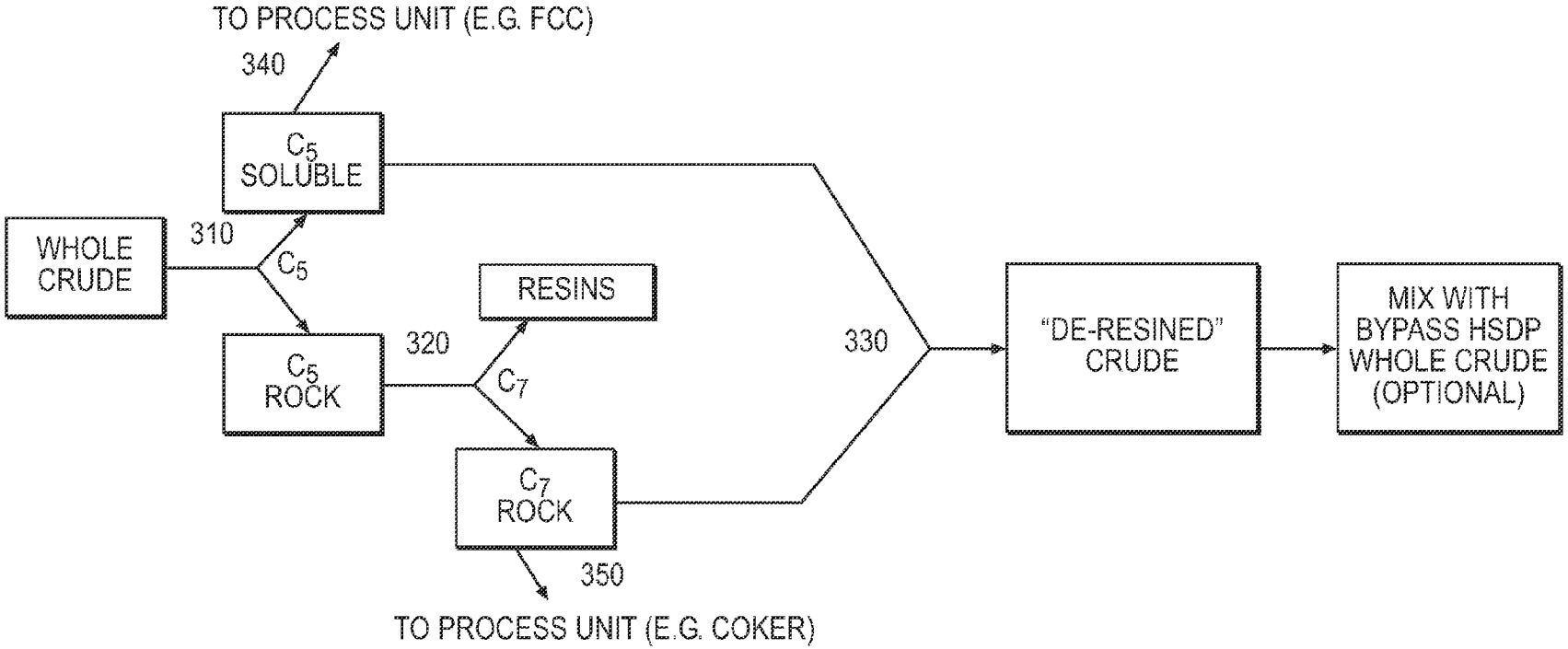
FIG. 3 is process scheme for the isolation of active resins from a HSDP crude oil, in accordance with one aspect of the invention.

For purpose of explanation and illustration, and not limitation, an exemplary embodiment of the method of isolating active resins from a HSDP crude oil in accordance with this aspect of the invention is shown in FIG. 3. Step 310 includes deasphalting the HSDP crude oil into at least a deasphalted oil (DAO) fraction and a first asphaltenes fraction. The deasphalting step 310 includes providing a first solvent. As described above, the first solvent can be any solvent suitable for precipitating asphaltenes from the crude oil depending on the solubility characteristics of the oil, such as propane, n-pentane, butane, hexane, heptane, light naphthas, and other suitable alternatives. In a preferred embodiment, the first solvent is pentane. Additionally, and/or alternatively, the HSDP crude oil can be provided as a fraction of whole crude oil. Examples of the whole crude oil fractions include atmospheric resid, vacuum resid, propane asphaltenes, or butane asphaltenes, and other suitable fractions.

Step 320 includes deasphalting the first asphaltenes fraction to isolate active resins from a second asphaltenes fraction. In a preferred embodiment, the deasphalting step 320 includes providing a second solvent. As described above, the second solvent can be any solvent suitable for extracting the resins from the asphaltenes fraction such as heptane, n-pentane, n-heptane, n-hexane, and other suitable alternatives. In a preferred embodiment, the second solvent is heptane.

Step 330 includes combining the DAO fraction and the second asphaltenes fraction to form a de-resinated crude. As described below in more detail, there are a number of alternative uses for the non-resin, by-product fractions. For example, step 340 includes processing the DAO fraction in a refinery or chemical plant component and step 350 includes processing the second asphaltenes fraction in a thermal conversion unit.

In a preferred embodiment, the HSDP crude oil has a TAN level greater than about 0.3 mg KOH/g.

In another preferred embodiment, the HSDP crude oil has a $S_{BN}$ level greater than about 90.

In another preferred embodiment, the HSDP crude oil contains n-heptane asphaltenes.

According to another aspect of the invention, a method of using components isolated from a high solvency dispersive power (HSDP) crude oil is provided. The method includes providing a HSDP crude oil; deasphalting the HSDP crude oil into at least a deasphalted oil (DAO) fraction and a first asphaltenes fraction; deasphalting the first asphaltenes fraction to isolate active resins from a second asphaltenes fraction; and selecting at least one of the DAO fraction, the active resins, or the second asphaltenes fraction for use in a refinery process.

As noted above, deasphalting the crude oil can be performed using a number of known techniques, but the use of a suitable solvent, such as pentane, is preferred. Similarly, deasphalting the first asphaltenes fraction can be performed using a number of known techniques, but the use of a suitable solvent, such as heptane, is preferred As described in detail above, in one preferred embodiment of the invention, the active resins are selected and blended with a base crude oil to create a blended crude oil to reduce fouling of a refinery component. The blended crude oil is fed to a refinery component.

In another preferred embodiment of the invention, the DAO fraction and the second asphaltenes fraction are combined to form a de-resinated crude. The de-resinated crude can be processed as a standard feed in a refinery crude slate. However, in the event the DAO fraction has compatibility issues when mixing with the second asphaltenes fraction, the de-resinated crude can be blended with a portion of the HSDP crude oil to reduce incompatibility. The blend of de-resinated crude and the HSDP crude oil can then be fed as a standard feed in a refinery crude slate. As such, a concentrated resin fraction can be obtained for refinery fouling mitigation, and the remainder of the crude oil can be used without the devaluing that might be caused by the separated by-product fractions.

As a further alternative, the deasphalted oil (DAO) fraction can be selected and processed in a refinery or chemical plant component. Exemplary refinery or chemical plant components include lubes processing units, fluid catalytic cracking (FCC) units, hydrocrackers, steam crackers, hydrotreaters, and other similarly affected process components. As another alternative the deasphalted oil (DAO) fraction can be used as a stream for blending with other refinery process streams, such as in the production of fuel oil.

In another preferred embodiment of the invention, the second asphaltenes fraction can be used in asphalt production.

Alternatively the second asphaltenes fraction can be processed in a thermal conversion unit, such as a coker or other suitable alternatives.

The present invention has been described mainly in the context of heat exchanger service in petroleum refinery operation but the invention is so limited; rather, it is suitable for reducing and/or mitigating fouling in other heat transfer equipment and refinery components including but not limited to furnaces, pipestills, cokers, visbreakers and the like. Furthermore, the use of the resins and resin extracts may be combined with other techniques for reducing and/or mitigating fouling. Such techniques include, but are not limited to, (i) the provision of low energy surfaces and modified steel surfaces in heat exchanger tubes, as described in U.S. patent application Ser. Nos. 11/436,602 and 11/436,802, (ii) the use of controlled mechanical vibration, as described in U.S. patent application Ser. No. 11/436,802, (iii) the use of fluid pulsation and/or vibration, which may be combined with surface coatings, as described in U.S. Provisional Patent Application No. 60/815,845, filed on Jun. 23, 2006, entitled "Reduction of Fouling in Heat Exchangers," (iv) the use of electropolishing on heat exchanger tubes and/or surface coatings and/or modifications, as described in U.S. Provisional Patent Application No. 60/751,985, and (v) combinations of the same, as described in U.S. Provisional Patent Application No. 60/815,844, filed on Jun. 23, 2006, entitled "A Method of Reducing Heat Exchanger Fouling in a Refinery," The disclosures of these patent applications are referred to for disclosures of these other techniques which may be used in conjunction with the present mitigation technique. The resins and resin extracts may also be used to supplement the use of a high solvency dispersive power (HSDP) oil as described in U.S. patent application Ser. No. 11/506,901, to which reference is made for a description of the blending crude oils with the HSDP crude oils for reducing asphaltene- and particulate-induced fouling.

The effectiveness of the resin extracts may be determined using a test rig similar to that described in application Ser. No. 11/506,901, to which reference is made for a description of the test rig.

FIG. 1 shows a test rig based on an Alcor™ HLPS-400 Liquid Process Simulator. The Alcor HLPS-400 Hot Liquid Process Simulator is a laboratory tool for predicting heat exchanger performance and the fouling tendencies of specific process fluids and is described, for example, at http://www.paclp.com/product/Alcor/lit_alcor/HLPS400.pdf. The Alcor HLPS operates in the laminar flow regime at accelerated fouling conditions compared to commercial heat exchangers which typically operate a high turbulent flow regime at much lower fouling rate but in spite of these differences, the Alcor HLPS has proven to be an excellent tool for predicting the relative fouling tendencies of fluids in commercial heat exchangers.

The test rig shown in FIG. 1 was used to measure the effect of adding asphaltic resin extracts on crude oil samples containing added solid particulates. The test rig includes a reservoir 10 containing a feed supply of the oil under test. The feed supply is heated to a temperature of approximately 150° C./302° F. and then fed into a shell 11 containing a vertically oriented heated rod 12. The heated rod 12, which is suitably formed from carbon steel, simulates a tube in a heat exchanger. The heated rod 12 is electrically heated to a predetermined temperature and maintained at the predetermined temperature during the trial. Typically rod surface temperatures are approximately 370° C./698° F. and 400° C./752° F. The feed supply is pumped across the heated rod 12 at a flow rate of approximately 3.0 ml/minute. The spent feed supply is collected in the top section of the reservoir 10 in which it is separated from the untreated feed supply oil by a sealed piston, to allow for once-through operation. The system is pressurized with nitrogen (400-500 psig) to ensure gases remain dissolved in the oil during the test. Thermocouple readings are recorded for the bulk fluid inlet and outlet temperatures and for surface of the rod 12.

During the constant surface temperature testing, foulant deposits and builds up on the heated surface and become thermally degraded to coke. The coke deposits cause an insulating effect that reduces the efficiency and/or ability of the surface to heat the oil passing over it. The resulting reduction in outlet bulk fluid temperature continues over time as fouling continues. This reduction in temperature is referred to as the outlet liquid $\Delta T$ (or dT) and can be dependent on the type of crude oil/blend, testing conditions and/or other effects, such as the presence of salts, sediment or other fouling promoting materials. A standard fouling test is carried out for 180 minutes. The total fouling, as measured by the total reduction in outlet liquid temperature is referred to as $\Delta T_{180}$ or $dT_{180}$.

EXPERIMENTAL

Example 1

A 75:25 vol:vol mixture of two asphaltic crude oils (Crude A and Crude B) was prepared by blending in order to create a baseline fouling sample. The compositions of the two crudes were as follows:

| Crude A | |
|---|---|
| API | 21.6 |
| Sulfur, wt. pct. | 3.4 |
| TAN | 0.14 |
| $S_{BN}$ | 60 |
| $I_N$ | 35 |

| Crude B | |
|---|---|
| API | 38.4 |
| Sulfur, wt. pct. | 0.92 |
| TAN | 0.1 |
| $S_{BN}$ | 28 |
| $I_N$ | 27.5 |

The resulting blend contained 7.5 wt % asphaltenes and >300 wppm filterable solids (particulates). The solids are known for increasing the fouling potential of this crude blend.

A resin fraction was prepared from an HSDP crude oil having the following composition:

HSDP Crude

| HSDP Crude | |
|---|---|
| API | 22.4 |
| Sulfur, wt. pct. | 0.2 |
| TAN | 0.8 |
| $S_{BN}$ | 132 |
| $I_N$ | 0 |

The resin fraction was prepared by first carrying out an n-pentane deasphalting at room temperature. This step precipitates the $C_5$-asphaltenes from the base oil/solvent mixture. This insoluble fraction ($C_5$-asphaltenes) was then collected by filtration and subsequently subjected to a n-heptane extraction at room temperature. The soluble fraction from this extraction can be generally termed the resin fraction of the crude oil. 250 wppm of this resin fraction [solvent-free basis] was added to the mixture of Crude A and B containing the particulates (measured as filterable solids). Runs with and without the added resins were carried out using the Alcor fouling simulation system.

Figure 2:
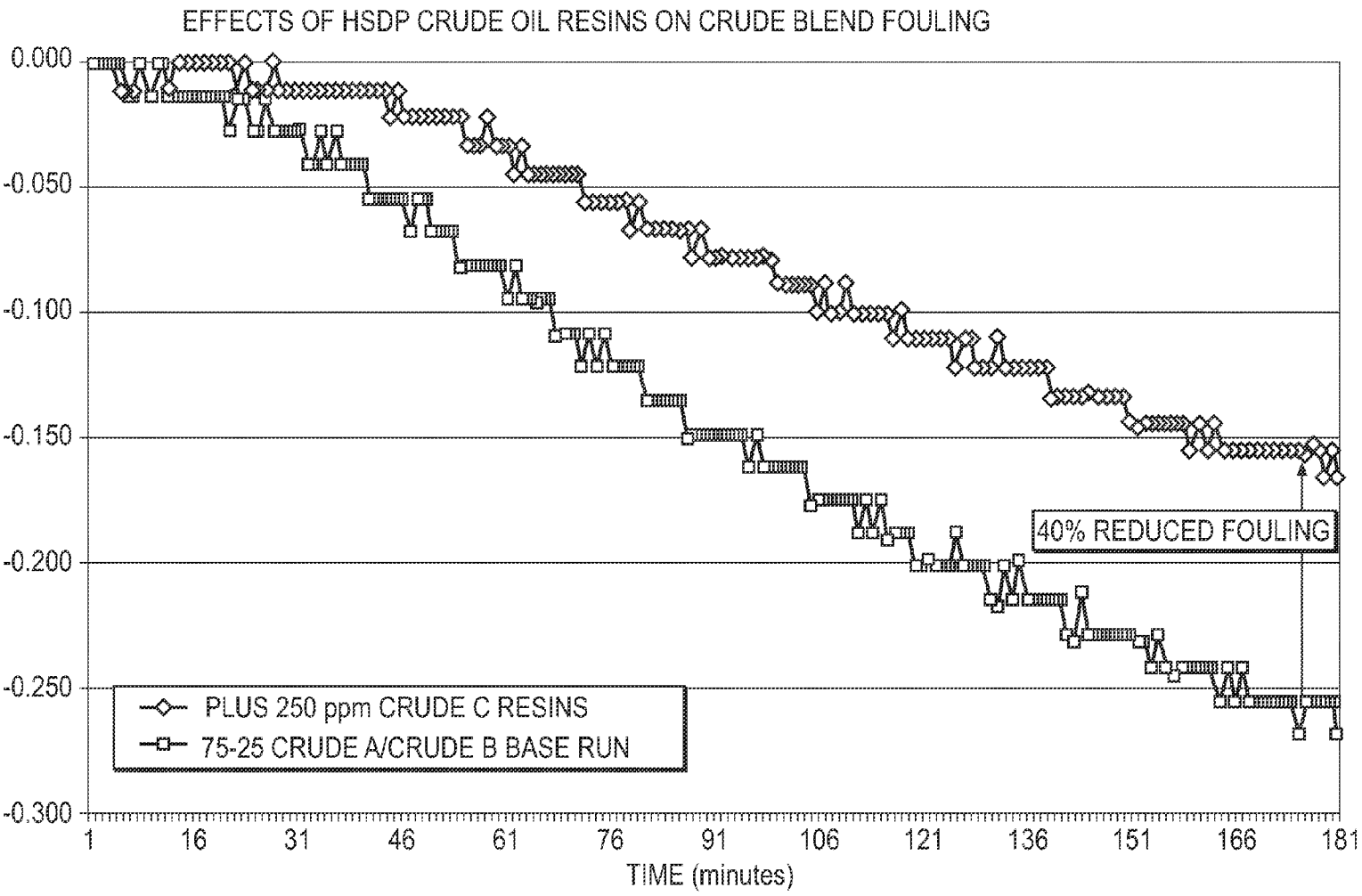
FIG. 2 is a graphical representation of the effects of a selected crude oil resin fraction on the fouling resulting from heating a selected crude oil blend.

A plot of the data collected from both runs is provided in FIG. 2. These data reveal the reduced fouling as a result of the addition of the resins fraction. After 180 minutes run time, a 40% reduction in fouling was noted.

Example 2

Figure 4:
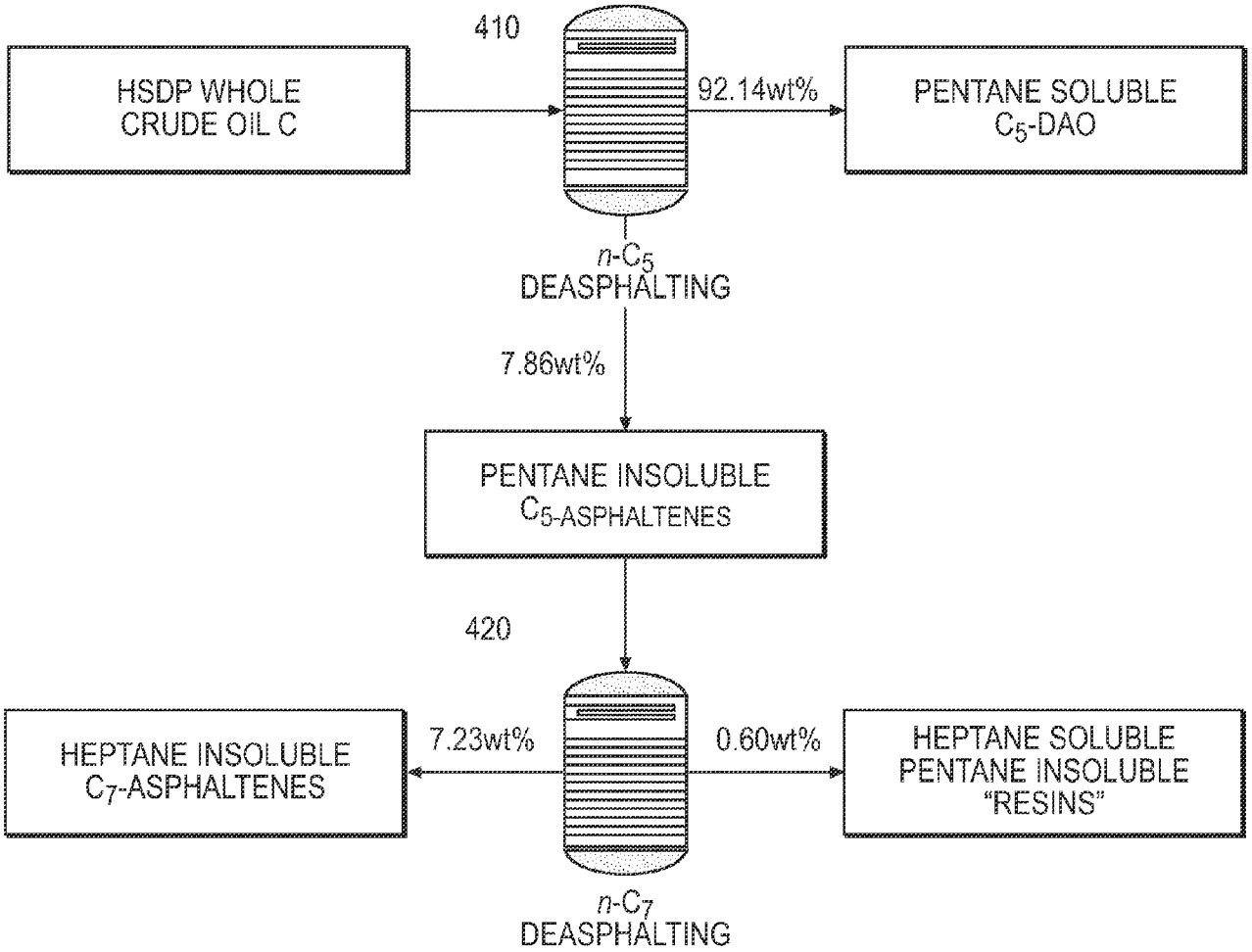
FIG. 4 is a process scheme for the isolation of active resins from HSDP whole crude C, in accordance with an exemplary embodiment of the invention.

The experimental isolation of active resins from HSDP whole crude oil C has been achieved. For purpose of explanation and illustration, and not limitation, an exemplary method of isolating active resins from HSDP whole crude oil C is shown in FIG. 4. Step 410 includes deasphalting the HSDP whole crude oil C using n-pentane ($C_5$) into a pentane soluble $C_5$-deasphalted oil (DAO) fraction and a pentane insoluble $C_5$-asphaltenes fraction. This deasphalting results in a 92.14% by weight pentane soluble $C_5$-deasphalted oil (DAO) fraction and a 7.86% by weight pentane insoluble $C_5$-asphaltenes fraction. Step 420 includes deasphalting the insoluble $C_5$-asphaltenes fraction using n-heptane ($C_7$) into a heptane soluble pentane insoluble resins fraction and a heptane insoluble $C_7$-asphaltenes fraction. The deasphalting results in an overall yield of 0.60% by weight of active resins. These resins were shown experimentally to reduce fouling by 40% when added to a fouling crude blend containing 200 wppm of iron oxide compared to the case with no added resins.

Example 3

Figure 5:
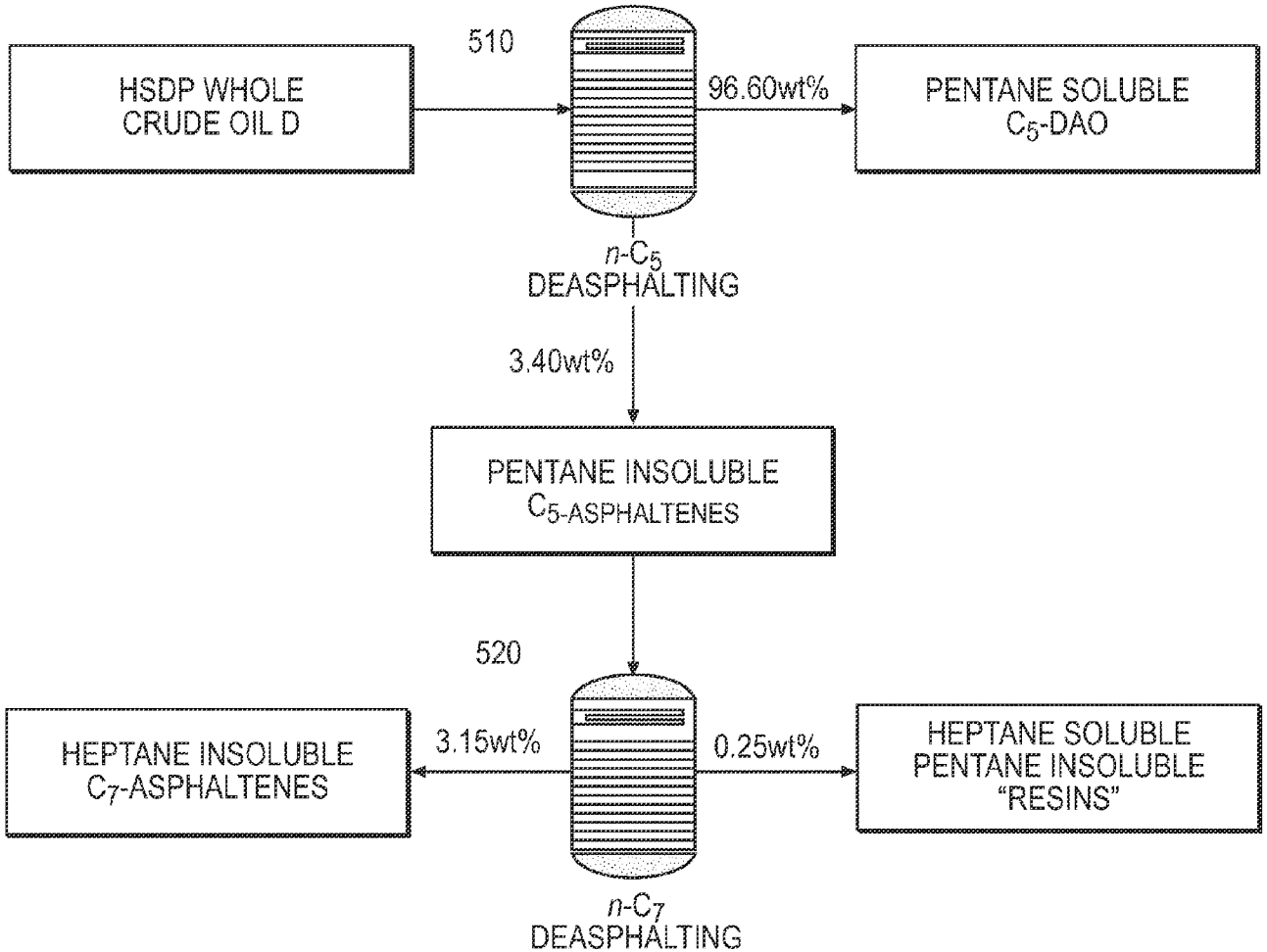
FIG. 5 is a process scheme for the isolation of active resins from HSDP whole crude D, in accordance with an exemplary embodiment of the invention.

The experimental isolation of active resins from HSDP whole crude oil D has been achieved. For purpose of explanation and illustration, and not limitation, an exemplary method of isolating active resins from HSDP whole crude oil D is shown in FIG. 5. Step 510 includes deasphalting the HSDP whole crude oil D using n-pentane ($C_5$) into a pentane soluble $C_5$-deasphalted oil (DAO) fraction and a pentane insoluble $C_5$-asphaltenes fraction. This deasphalting results in a 96.60% by weight pentane soluble $C_5$-deasphalted oil (DAO) fraction and a 3.40% by weight pentane insoluble $C_5$-asphaltenes fraction. Step 520 includes deasphalting the insoluble $C_5$-asphaltenes fraction using n-heptane ($C_7$) into a heptane soluble pentane insoluble resins fraction and a heptane insoluble $C_7$-asphaltenes fraction. The deasphalting results in an overall yield of 0.25% by weight of active resins. These resins were shown experimentally to reduce fouling by 26% when added to a fouling crude blend containing 200 wppm of iron oxide compared to the case with no added resins.

Various modifications can be made in our invention as described herein, and many different embodiments of the device and method can be made while remaining within the spirit and scope of the invention as defined in the claims without departing from such spirit and scope. It is intended that all matter contained in the accompanying specification shall be interpreted as illustrative only and not in a limiting sense.

What is claimed is:

1. A method of isolating active resins from a high solvency dispersive power (HSDP) oil, comprising:
- providing a HSDP oil;
- deasphalting the HSDP oil into at least a deasphalted oil (DAD) fraction and a first asphaltenes fraction;
- deasphalting the first asphaltenes fraction to isolate active resins from a second asphaltenes fraction; and
- combining the DAO fraction and the second asphaltenes fraction to form a de-resinated crude.

2. The method of claim wherein deasphalting the HSDP oil comprises providing a first solvent.

3. The method of claim 2, wherein the first solvent is pentane.

4. The method of claim 1, wherein deasphalting the first asphaltenes comprises providing a second solvent.

5. The method of claim 4, wherein the second solvent is heptane.

6. The method of claim 1, wherein the HSDP oil has a TAN level greater than about 0.3 mg KOH/g.

7. The method of claim 1, wherein the HSDP oil has a SBN level greater than about 90.

8. The method of claim 1, wherein the HSDP oil contains n-heptane asphaltenes.

9. The method of claim 1, wherein the HSDP oil is provided as a fraction of whole crude oil.

10. The method of claim 9, wherein the fraction of whole crude oil is selected from the group consisting of atmospheric resid, vacuum resid, propane asphaltenes, or butane asphaltenes.

11. A method of using components isolated from a high solvency dispersive power (HSDP) oil, comprising:
- providing a HSDP oil;
- deasphalting the HSDP oil into at least a deasphalted (DAO) fraction and a first asphaltenes fraction;
- deasphalting the first asphaltenes fraction to Isolate active resins from a second asphaltenes fraction; and
- selecting at least one of the DAO fraction, the active resins, or the second asphaltenes fraction for use in a refinery process.

12. The method of claim 11, further comprising combining the DAO fraction and the second asphaltenes fraction to form a de-resinated crude.

13. The method of claim 12, further comprising, processing the de-resinated crude as a standard feed in a refinery crude slate.

14. The method of claim 11, further comprising processing the deasphalted oil (DAD) fraction in a refinery or chemical plant component.

15. The method of claim 14, wherein the refinery or chemical plant component is selected from the group consisting of lobes processing units, fluid catalytic cracking (FCC) units, hydrocrackers, steam crackers, and hydrotreaters.

16. The method of claim 11, further comprising using the second asphaltenes fraction in asphalt production.

17. The method of claim 11, further comprising processing the second asphaltenes fraction in a thermal conversion unit.

18. The method of claim 17, wherein the thermal conversion unit is a coker.

19. The method of claim 11, wherein deasphalting the HSDP oil comprises providing a first solvent.

20. The method of claim 19, wherein the first solvent is pentane.

21. The method of claim 11, wherein deasphalting the first asphaltenes comprises providing a second solvent.

22. The method of claim 21, wherein the second solvent is heptane.

23. A method of using components isolated from a high solvency dispersive power (HSDP) oil, comprising:

providing a HSDP oil;

deasphalting the HSDP oil into at least a deasphalted oil (DAO) fraction and a first asphaltenes fraction;

deasphalting first asphaltenes fraction to isolate active resins from a second asphaltenes fraction;

selecting the active resins for use in a refinery process; and blending a predetermined amount of the active resins with a base crude oil to create a blended crude oil to reduce fouling of refinery component.

24. The method of claim 23, further comprising feeding the blended crude oil to a refinery component.

25. The method of claim 23, wherein the predetermined amount of active resin is up to 1000 ppmw.

26. A method of using components isolated from a high solvency dispersive power (FISDP) oil, comprising;

providing a HSDP oil;

deasphalting the HSDP oil into at least a deasphalted oil (DAO) fraction on and a first asphaltenes fraction;

deasphalting the first asphaltenes fraction to isolate active resins from a second asphaltenes fraction;

selecting at least one of the DAD fraction, the active resins, or the second asphaltenes fraction for use in a refinery process;

combining the DAD fraction and the second asphaltenes fraction to form a de-resinated crude; and blending the de-resinated crude with a portion of the HSDP oil to reduce incompatibility between the DAO fraction and the second asphaltenes fraction.

27. The method of claim 26, further comprising processing the blend of de-resinated crude and the HSDP oil as a standard feed in a refinery crude slate.

28. A method of using components isolated from a high solvency dispersive power HSDP) oil, comprising:

providing a HSDP oil;

deasphalting a HSDP oil into at least a deasphalted oil (DAO) fraction and a first asphaltenes fraction;

deasphalting the first asphaltenes fraction to isolate active resins from a second asphaltenes fraction;

selecting the DAO fraction for use in a refinery process; and using the deasphalted oil (DAO) fraction as a stream for blending with other refinery process streams.

29. The method of claim 28, wherein the deasphalted oil (DAO) fraction is used as a stream fig blending with other refinery process streams in the production of fuel oil.

* * * * *